US008728570B2

(12) United States Patent
Matsuyama

(10) Patent No.: US 8,728,570 B2
(45) Date of Patent: May 20, 2014

(54) DROPLET DISCHARGE METHOD AND DROPLET DISCHARGE DEVICE

(75) Inventor: Ryotaro Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 411 days.

(21) Appl. No.: 12/783,133

(22) Filed: May 19, 2010

(65) Prior Publication Data

US 2010/0302294 A1 Dec. 2, 2010

(30) Foreign Application Priority Data

May 27, 2009 (JP) ..... 2009-127582

(51) Int. Cl.
*B05D 5/06* (2006.01)

(52) U.S. Cl.
USPC ..... 427/162

(58) Field of Classification Search
USPC ..... 427/162
See application file for complete search history.

(56) References Cited

U.S. PATENT DOCUMENTS

| | | | | |
|---|---|---|---|---|
| 5,847,723 | A * | 12/1998 | Akahira et al. | 347/14 |
| 6,893,103 | B2 | 5/2005 | Okada et al. | |
| 2004/0004643 | A1* | 1/2004 | Satomura | 347/9 |
| 2007/0111626 | A1* | 5/2007 | Kato | 445/14 |
| 2009/0117261 | A1* | 5/2009 | Sakai | 427/66 |

FOREIGN PATENT DOCUMENTS

| | | | |
|---|---|---|---|
| JP | 11-248927 | A | 9/1999 |
| JP | 2002-196127 | A | 7/2002 |
| JP | 2008-178989 | A | 8/2008 |

* cited by examiner

*Primary Examiner* — Elizabeth Burkhart
(74) *Attorney, Agent, or Firm* — Global IP Counselors, LLP

(57) ABSTRACT

A droplet discharge method is for discharging a liquid into a plurality of drawing regions partitioned on a substrate from a plurality of nozzles formed in a droplet discharge head while moving the droplet discharge head relative to the substrate. The droplet discharge method includes dividing the nozzles into a plurality of nozzle groups so that the nozzles in one of the nozzles groups face the same drawing region, correcting an amount of the liquid discharged from the nozzles so that an average value of an amount of the liquid discharged from the nozzles constituting the nozzle groups is substantially uniform among the nozzle groups, and discharging the liquid from the nozzles while the droplet discharge head is moved relative to the substrate.

3 Claims, 7 Drawing Sheets

DROPLET DISCHARGE METHOD AND DROPLET DISCHARGE DEVICE

CROSS-REFERENCE TO RELATED APPLICATIONS

This application claims priority to Japanese Patent Application No. 2009-127582 filed on May 27, 2009. The entire disclosure of Japanese Patent Application No. 2009-127582 is hereby incorporated herein by reference.

BACKGROUND

1. Technical Field

The present invention relates to a droplet discharge method and a droplet discharge device.

2. Related Art

In recent years, it has been proposed that color filters be manufactured using an inkjet method for discharging ink with a droplet discharge head (e.g., see Japanese Laid-Open Patent Application No. 11-248927). With this manufacturing method, liquid (droplets) containing a coloring material is discharged from a plurality of nozzles provided in the droplet discharge head that moves in a relative fashion in relation to a substrate to arrange (draw) the liquid, and the arranged liquid is dried or otherwise solidified to form a colored film that corresponds to a pixel.

In the manufacturing method that uses the inkjet method, there is a slight amount of variability in the discharge amount of the liquid from the plurality of nozzles. There are cases in which linear grayscale nonuniformity occurs in the color filter when the color filter is drawn with variability in the discharge amount of the liquid. Since such linear nonuniformity is readily visible, the quality of the image displayed via the color filter is reduced. In view of this situation, corrections are made to make the discharge amount of the liquid discharged from the nozzles uniform and reduce the nonuniformity of the discharge amount among the nozzles by adjusting the drive signals fed to the droplet discharge head.

SUMMARY

However, problems remain in the conventional droplet discharge method described above. Specifically, the amount of the liquid discharged from the nozzles is adjusted in a stepwise manner using drive signals fed to the droplet discharge head. Accordingly, the variability of the discharge amount of the liquid discharged from the nozzles cannot be made one-fourth or less than the variability prior to adjustment in the case the discharge amount of the liquid is adjusted in, e.g., four steps. It is therefore difficult to make the discharge amount of the liquid discharged from the nozzles perfectly uniform. A problem is thus presented in that linear grayscale nonuniformity still occurs.

The present invention was contrived in view of the prior art problems described above, and an object thereof is to provide a droplet discharge method and a droplet discharge device in which adjustment of the liquid discharge amount in the drawing regions is further facilitated.

A droplet discharge method according to a first aspect is a method for discharging a liquid into a plurality of drawing regions partitioned on a substrate from a plurality of nozzles formed in a droplet discharge head while moving the droplet discharge head relative to the substrate. The droplet discharge method includes dividing the nozzles into a plurality of nozzle groups so that the nozzles in one of the nozzles groups face the same drawing region, correcting an amount of the liquid discharged from the nozzles so that an average value of an amount of the liquid discharged from the nozzles constituting the nozzle groups is substantially uniform among the nozzle groups, and discharging the liquid from the nozzles while the droplet discharge head is moved relative to the substrate.

A droplet discharge device according to another aspect includes a droplet discharge head, a movement unit, and a correction unit. The droplet discharge head includes a plurality of nozzles configured and arranged to discharge droplets of a liquid into a plurality of drawing regions partitioned on a substrate. The movement unit is configured and arranged to move the droplet discharge head relative to the substrate. The correction unit is configured to divide the nozzles into a plurality of nozzle groups so that the nozzles in one of the nozzles groups face the same drawing region, and to correct an amount of the liquid discharged from the nozzles so that an average value of an amount of the liquid discharged from the nozzles constituting the nozzle groups is substantially uniform among the nozzle groups.

According to these aspects, control of the discharge amount in the drawing regions is further facilitated by correcting the average value of the discharge amounts in each nozzle group. Specifically, the height of the liquid level of the liquid discharged into the drawing regions is made uniform by making the average value of the discharge amounts of the nozzles constituting one nozzle group equivalent to the average value of the discharge amounts of the nozzles constituting the other nozzle groups. Thus, even when the amount of the liquid discharged from one nozzle constituting the nozzle group is considerable, the average value of the discharge amounts for the nozzle groups overall can be set to a desired value by reducing the discharge amounts of the liquid discharged from other nozzles. Accordingly, the average value of the discharge amounts can be more finely corrected for the nozzle groups overall in comparison with the case in which the discharge amounts of the nozzles are corrected to achieve a predetermined value. Therefore, the height of the liquid level of the liquid discharged in the drawing regions is more uniform and the occurrence of linear grayscale nonuniformity can be more reliably reduced.

The droplet discharge method may correct the amount of the liquid discharged from each of the nozzles in a stepwise manner.

The droplet discharge device may be configured so that the correction unit is configured to correct the amount of the liquid discharged from each of the nozzles in a stepwise manner.

According to these aspects, the average values of the discharge amounts of the liquid discharged from the nozzles in each nozzle group are corrected so as to yield a predetermined amount by correcting the amounts of liquid discharged from the nozzles in a stepwise manner. Accordingly, the average value of the discharge amounts of the nozzle groups overall can be finely corrected, even when the discharge amounts of the liquid discharged from the nozzles cannot be finely corrected in a stepwise manner.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
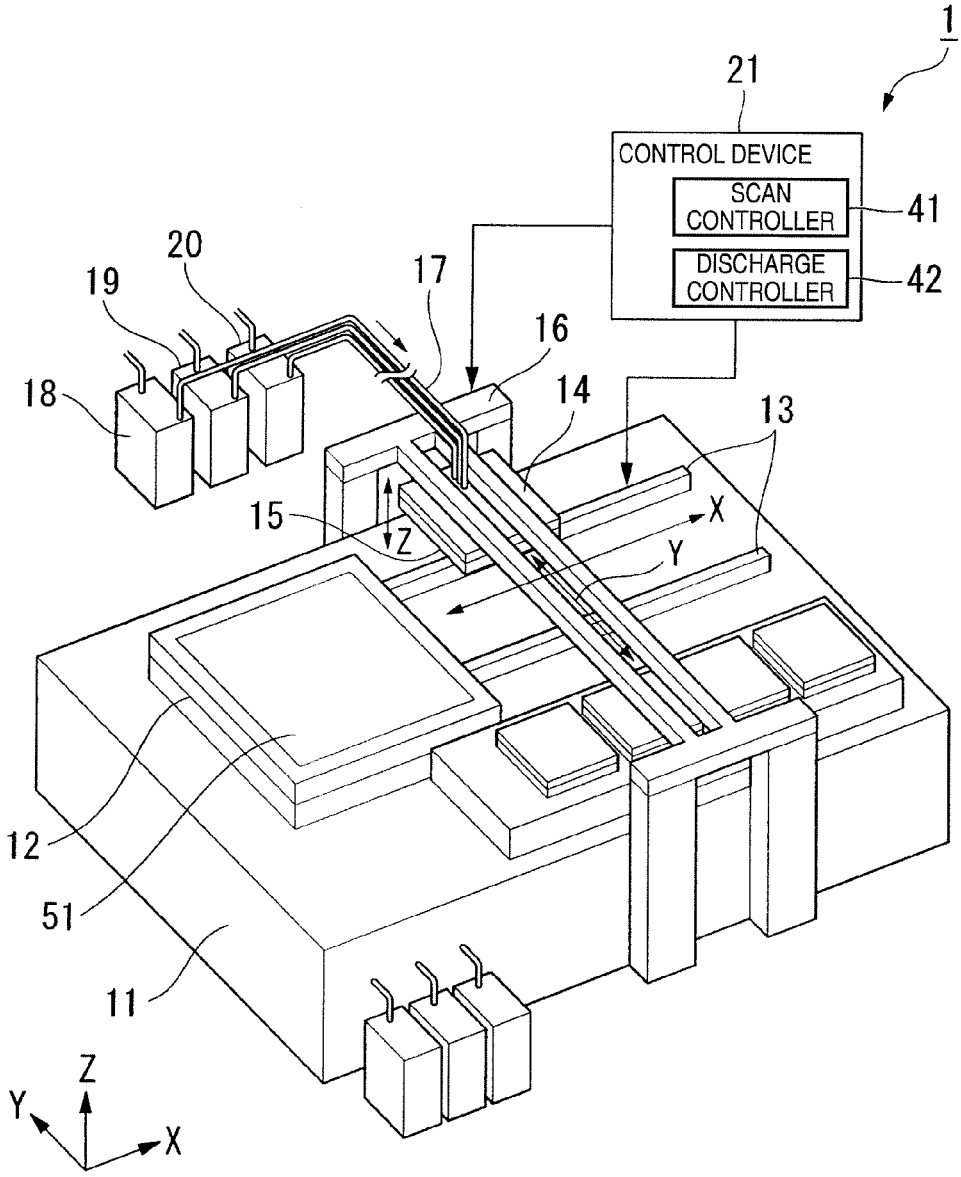
FIG. 1 is a perspective view showing the droplet discharge device in an embodiment of the present invention.

An embodiment of the droplet discharge method and droplet discharge device of the present invention is described below with reference to the drawings. In the drawings used in the following description, the reduced scale is suitably varied in order to allow the members to be recognized.

Droplet Discharge Device

First, the droplet discharge device of the present embodiment will be described.

The droplet discharge device 1 is a device for discharging liquid in predetermined regions of a later-described mother substrate (substrate) 51 using, e.g., an inkjet method to form a color filter layer 55 (described further below), as shown in FIG. 1. The droplet discharge device 1 is provided with a device trestle 11, a work stage 12, a stage movement device (movement mechanism) 13, a carriage 14, droplet discharge heads 15, a carriage movement device (movement device) 16, a tube 17, first through third tanks 18 to 20, and a control device 21. At least one of the stage movement device 13 and the carriage movement device 16 constitutes a movement unit of the present embodiment.

The device trestle 11 is a support platform for the work stage 12 and the stage movement device 13. The work stage 12 is arranged in the X direction, which is the primary scan direction, on the device trestle 11 so that the work stage 12 can be moved by the stage movement device 13, and the mother substrate 51 transported from an upstream transport device (not shown) is held on the XY plane by a chucking mechanism.

The stage movement device 13 is provided with a linear guide and ball screw, or another direct drive mechanism, and the work stage 12 is moved in the X direction the basis of a stage position control signal that indicates the X coordinate of the movement destination of the work stage 12 inputted from the control device.

The carriage 14 holds the droplet discharge heads 15 and is provided so that the carriage movement device 16 can move the carriage 14 in the Z direction and the Y direction, which is the secondary scan direction.

The droplet discharge heads 15 are provided in corresponding fashion to R (red), G (green), and B (blue) liquid, and are connected to respective tubes 17 via the carriage 14.

R (red) liquid is fed from a first tank 18 to the droplet discharge head 15 that corresponds to R (red) via the tube 17, G (green) liquid is fed from a second tank 19 to the droplet discharge head 15 that corresponds to G (green) via the tube 17, and B (blue) liquid is fed from a third tank 20 to the droplet discharge head 15 that corresponds to B (blue) via the tube 17.

Figure 2:
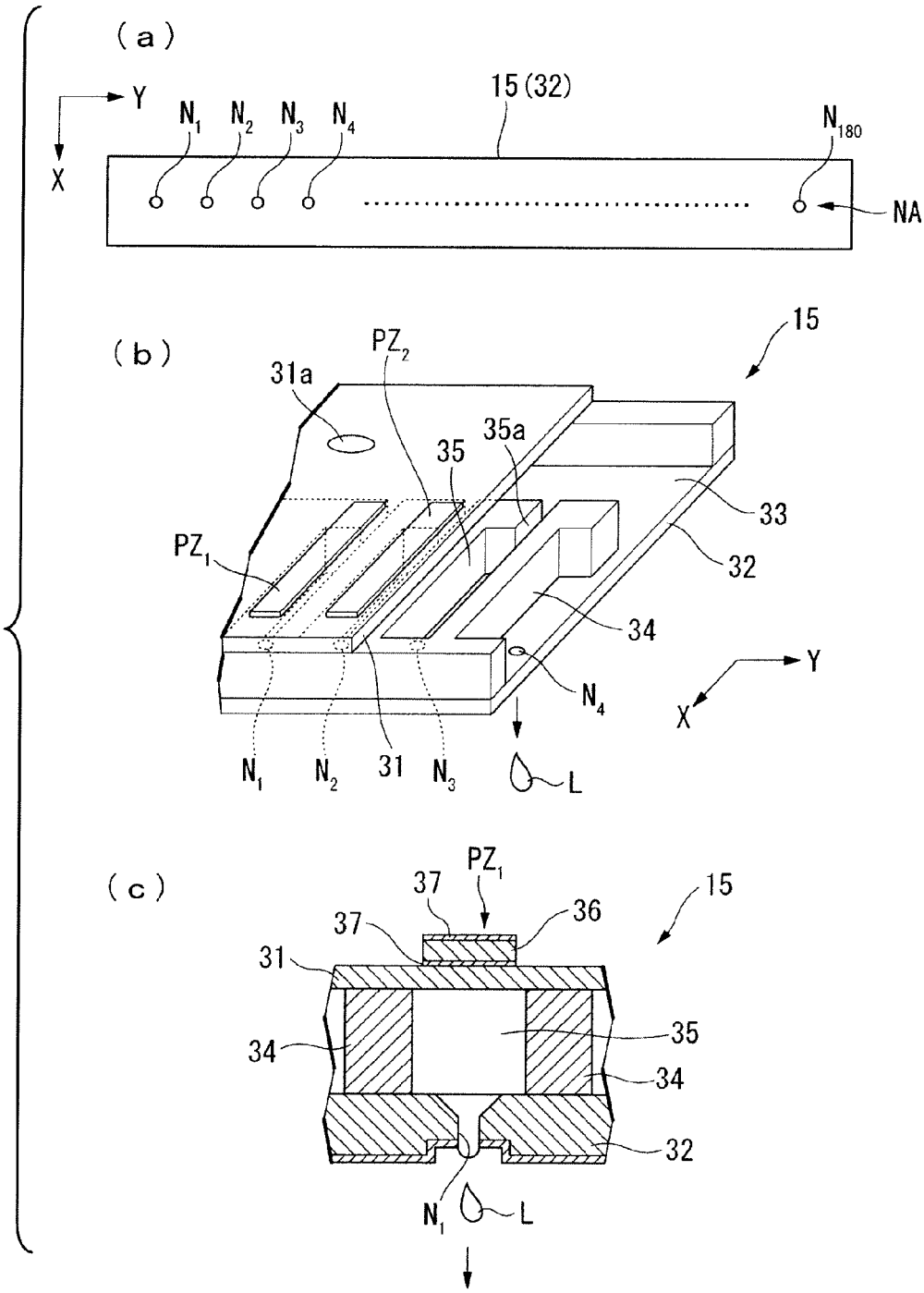
FIG. 2 includes a series of diagrams showing the configuration of a droplet discharge head.

The droplet discharge heads 15 are provided with a plurality (e.g., 180) of nozzles $N_1$ to $N_{180}$ (may hereinafter be generically referred to as "nozzles N") arrayed in equidistant intervals in the Y direction, as shown in FIG. 2(*a*). These nozzles $N_1$ to $N_{180}$ formed into nozzle rows NA.

The droplet discharge heads 15 are provided with only a single nozzle row NA, but a plurality of rows may provided, and the number of nozzles N constituting the nozzle rows NA is not limited to 180. The number of droplet discharge heads 15 arranged in the carriage 14 can be modified as required. A plurality of carriages 14 may furthermore be provided in sub-carriage units.

Since there is considerable variability in the liquid discharge amounts for the nozzles at the two ends among the plurality of nozzles $N_1$ to $N_{180}$ (e.g., nozzles $N_1$ to $N_9$ and nozzles $N_{171}$ to $N_{180}$), there may be cases in which such are not used for discharging liquid.

The droplet discharge heads 15 are provided with vibration plate 31 having a material feed hole 31*a* connected to the tube 17, a nozzle plate 32 in which the nozzles $N_1$ to $N_{180}$ are provided, a reservoir 33 provided between the vibration plate 31 and the nozzle plate 32, a plurality of partition walls 34, and a plurality of liquid retaining portions 35, as shown in FIG. 2(*b*).

Drive elements $PZ_1$ to $PZ_N$ (may hereinafter be generically referred to as "drive elements PZ") are arranged on the vibration plate 31 in correspondence to the nozzles $N_1$ to $N_{180}$. The drive elements PZ are, e.g., piezoelements.

The reservoir 33 is designed to be filled with a liquid fed via the material feed hole 31*a*.

The liquid retaining portions 35 are formed by being enclosed by the vibration plate 31, the nozzle plate 32, and a pair of partition walls 34. The liquid retaining portions 35 are formed in a one-to-one correspondence to the nozzles $N_1$ to $N_M$. The liquid is introduced from the reservoir 33 via a feed port 35*a* provided between the pair of partition walls 34.

A single drive element PZ is provided with a piezoelectric material 36 and a pair of electrodes 37 that hold the piezoelectric material therebetween, as shown in FIG. 2(*c*). The drive element PZ is configured to cause the piezoelectric material 36 to contract when a drive signal is applied between the pair of electrodes 37, and the vibration plate 31 is simultaneously caused to flex outward (the side opposite from the liquid-retaining portion 35) together with the drive element PZ due to the contraction of the piezoelectric material 36 to increase the volume of the liquid-retaining portion 35.

Therefore, the liquid flows in to the reservoir 33 via the feed port 35*a* in an amount that corresponds to the increased volume inside the liquid-retaining portion 35. When the drive signal applied to the drive element PZ is stopped in such a state, the drive element PZ and the vibration plate 31 return to their former shapes, and the liquid-retaining portion 35 also returns to its original volume. The pressure of the liquid inside the liquid-retaining portion 35 is thereby increased, and a droplet L of the liquid is discharged from the nozzle $N_1$ toward the mother substrate 51.

The carriage movement device 16 forms a bridge structure that straddles the device trestle 11, as shown in FIG. 1, and is provided with a linear guide and ball screw, or another direct drive mechanism along the Y and Z directions. The carriage 14 is moved in the Y and Z directions on the basis of a carriage position control signal that indicates the Y and Z coordinates of the movement destination of the carriage 14 inputted from the control device 21.

The tubes 17 are used for feeding the liquid and provide a connection between the carriage 14 and the first through third tanks 18 to 20.

The first tank 18 stores the liquid for R (red) and feeds the liquid to the droplet discharge head 15 that corresponds to R (red) via the tube 17. The second tank 19 stores the liquid for G (green) and feeds the liquid to the droplet discharge head 15 that corresponds to G (green) via the tube 17. The third tank 20 stores the liquid for B (blue) and feeds the liquid to the droplet discharge head 15 that corresponds to B (blue) via the tube 17.

The control device 21 is provided with a scan controller 41 for controlling the scanning of the droplet discharge heads 15, and a discharge controller (correction unit) 42 for controlling the discharge of the liquid from the nozzles N.

The scan controller 41 controls the operation for positioning the mother substrate 51 by moving the work stage 12, and the scan controller 41 for controlling the operation for positioning the droplet discharge heads 15 by moving the carriage 14. The scan controller 41 outputs a stage position control signal to the stage movement device 13, and positions the mother substrate 51; and outputs a carriage position control signal to the carriage movement device 16 and positions the droplet discharge heads 15.

The discharge controller 42 outputs drawing data and a drive signal to the droplet discharge heads 15 and causes the liquid to be discharged from the nozzles N. The discharge controller 42 feeds four types of drive signals to the drive elements PZ that correspond to the nozzles N, and controls the discharge amounts from the nozzles N in four steps. Here, variability occurs in the discharge amounts of the liquid discharged from the nozzles N when the same drive signal is fed to the drive elements PZ that correspond to the nozzles N to cause the liquid to be discharged. In view of the above, the discharge controller 42 groups the plurality of nozzles N for each plurality of nozzles N positioned above the same later-described drawing region 54 into a plurality of nozzle groups NG (nozzle groups NGA to NGD; see FIG. 7). The drive signal is selected and fed to the drive elements PZ so that the average value of the discharge amounts of the liquid discharged from the plurality of nozzles N constituting the nozzle groups NG achieves a predetermined value.

Figure 3:
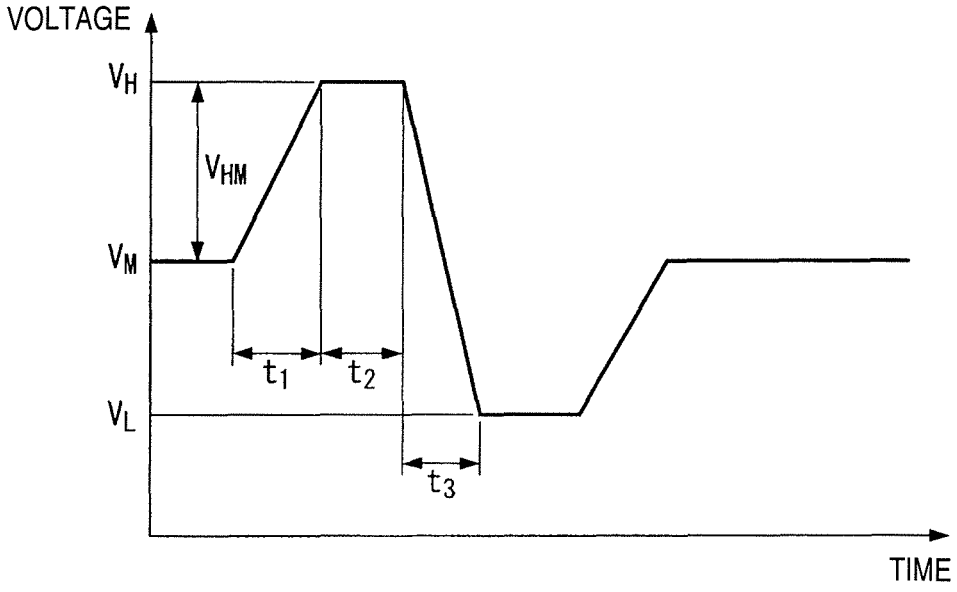
FIG. 3 is a diagram showing the waveform of the drive signal.

Specifically, the discharge controller 42 corrects the discharge amounts of the liquid from the nozzles N using the voltage component in a drive signal having a waveform such as that shown in FIG. 3.

Figure 4:
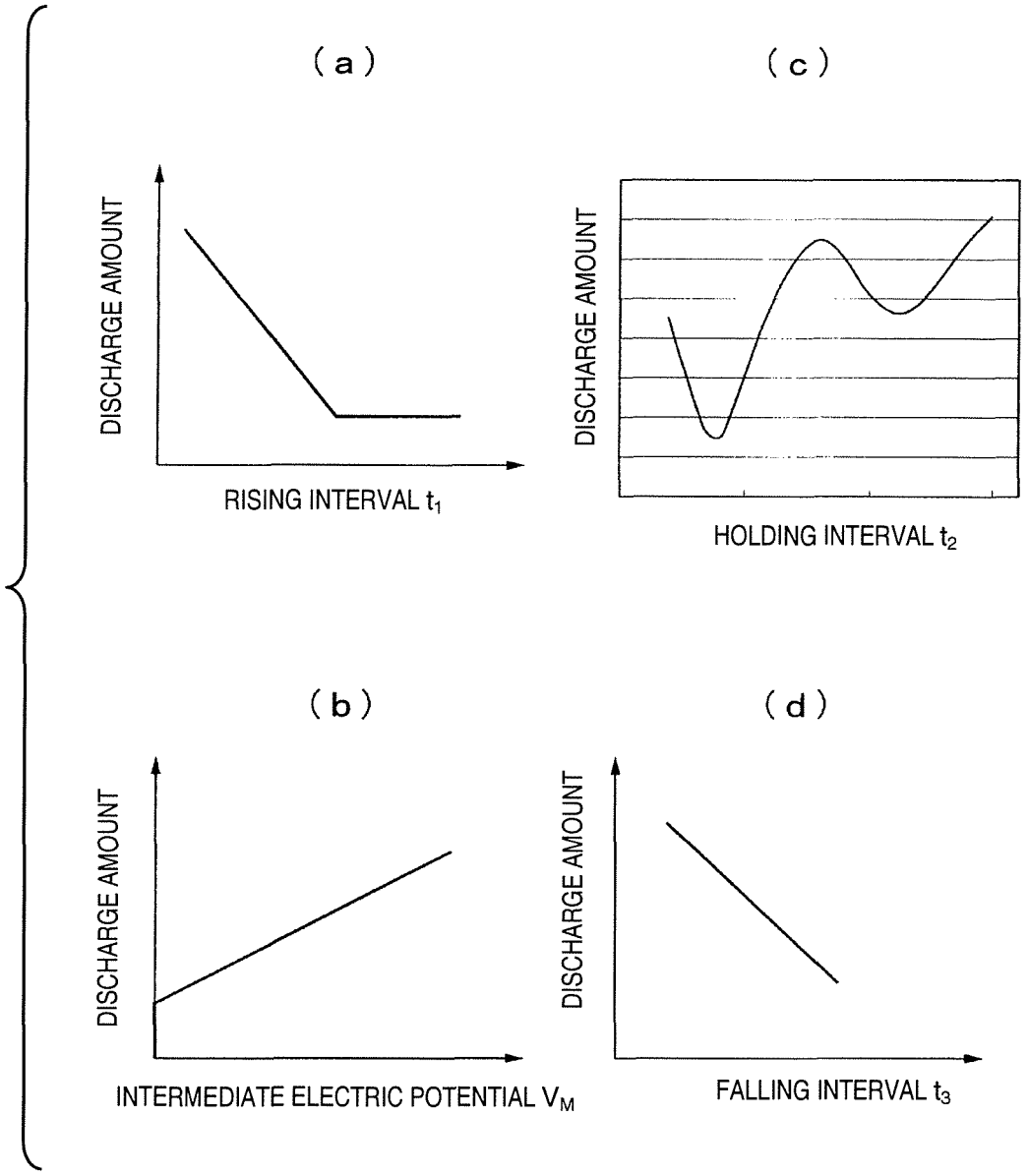
FIG. 4 includes diagrams (a) to (d) for showing the relationship between the waveform of the drive signal and the discharge amount of the liquid.

During the rise interval $t_1$ in FIG. 3, the volume of the liquid-retaining portion 35 adjacent to the nozzles N increases and the liquid is fed into the liquid-retaining portion 35. Here, the position of the meniscus is moved to the liquid-retaining portion 35 side due to the increased the volume of the liquid-retaining portion 35 during the rise interval $t_1$. This movement distance increases as the length of the rising interval $t_1$ is reduced. This is due to the fact that the meniscus is drawn into the liquid-retaining portion 35 with greater force as the rising interval $t_1$ is reduced in length. Accordingly, the meniscus is considerably moved to the liquid-retaining portion 35 side and the discharge amount of the liquid can be reduced by an amount commensurate with the distance that the meniscus is drawn inward by directly and rapidly transitioning to the discharge operation, as shown in FIG. 4(*a*). Conversely, when the rising interval $t_1$ is increased and the distance the meniscus moves toward the liquid-retaining portion 35 side is reduced, the discharge amount of the liquid is increased by an amount commensurate with the distance that the meniscus is drawn inward by a reduced distance.

The electric potential $V_M$ (intermediate electric potential) prior to rising affects the movement distance of the meniscus. When the intermediate electric potential $V_M$ is brought close to the electric potential $V_H$ in a charging state and the electric potential difference $V_{HM}$ is reduced, the meniscus substantially does not move even when the rising interval $t_1$ is shortened, as shown in FIG. 4(*b*). Accordingly, the amount of the liquid discharged substantially does not change even when a rapid transition is made to the discharge operation. On the other hand, when the electric potential difference $V_{HM}$ is increased, the distance the meniscus moves is increased. Therefore, the discharge mount is reduced by an amount equivalent to the distance that the meniscus is drawn inward when a transition is rapidly made to the discharge operation.

When the volume change of the liquid-retaining portion 35 ends, the meniscus thus drawn inward to the liquid-retaining portion 35 side attempts to return to its original position, and the meniscus vibrates based on the original position. Accordingly, when a transition to the discharge operation is made at the time that the meniscus has vibrated to the liquid-retaining portion 35 side, the discharge amount is reduced by an amount equivalent to the distance that the meniscus is drawn inward. On the other hand, when a transition to the discharge operation is made at the time that the meniscus has vibrated to the opposite side of the liquid-retaining portion 35, the discharge amount is increased by an amount equivalent to the distance that the meniscus considerably extends outward. Therefore, the discharge amount reflects periodic fluctuation in which it increases or decreases repeatedly in accompaniment with the increase in the holding interval $t_2$, as shown in FIG. 4(*c*).

The falling interval $t_3$ in FIG. 3 affects the applied pressure when the liquid is pressed from the nozzles N to the exterior. When the falling interval $t_3$ is short, the applied pressure is increased; and when the falling interval $t_3$ is long, the applied pressure is reduced. When the applied pressure is high, the discharge amount is increased in a commensurate fashion because the liquid flies out from the nozzles N with good force, as shown in FIG. 4(*d*). Conversely, when the applied pressure is low, the discharge amount is reduced in a commensurate fashion because the liquid is slowly pressed out.

As described above, the discharge amount of the liquid can be corrected by making use of the fluctuations in the discharge amount caused by the behavior of the meniscus and by controlling the drive signals. In the present embodiment, the discharge amount of the liquid is corrected by varying the intermediate electric potential $V_M$ in a stepwise manner using the steps of the drive signal. The discharge amount of the liquid may be corrected by varying other conditions in a stepwise manner using the steps of the drive signal.

Color Filter

Next, the color filter manufactured using the droplet discharge device 1 configured in the manner described above will be described.

Figure 5:
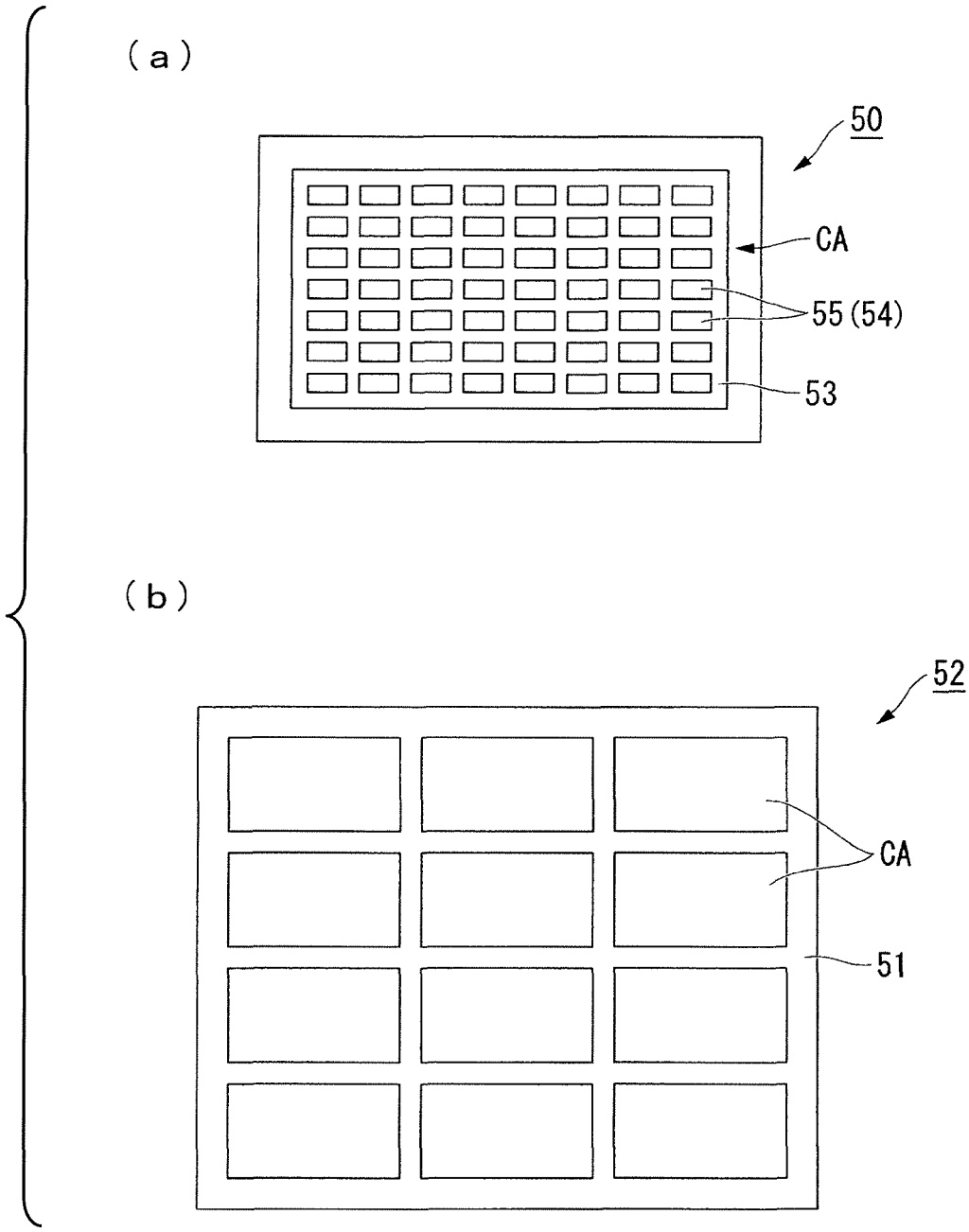
FIG. 5 includes schematic plan views showing the color filter and the color filter substrate.

A color filter 50 is manufactured by dividing a color filter substrate 52 into a plurality of panel regions CA, the panel regions CA being provided on a large-surface-area mother substrate 51 made of glass, a plastic material, or the like, as shown in FIGS. 5(*a*) and 5(*b*).

The panel regions CA are arranged in the form of a matrix and have a plurality of drawing regions 54 partitioned by a bank 53. The drawing regions 54 are arranged in the form of a matrix and have a color filter layer 55 formed therein.

The array of color filter layers 55 has the same color in one direction, and in the orthogonal direction, colors are repeated in the sequence of R (red), G (green), and B (blue). In other words, the color filter layers 55 are disposed in a striped arrangement in which the color filter layers 55 of the same color provided in a linear fashion in a single direction are arranged in alternating fashion in the orthogonal direction.

Figure 6:
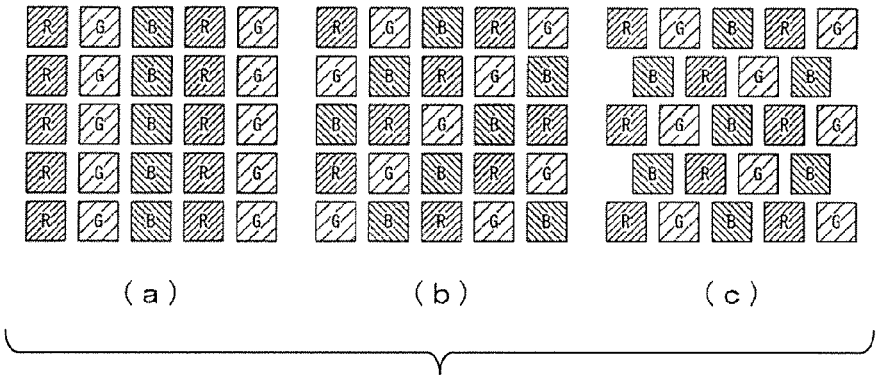
FIG. 6 includes plan views showing the arrangement of the color filter layer.

The arrangement of the color filter layers 55 is not limited to the striped arrangement shown in FIG. 6(*a*); it is also possible to use a mosaic arrangement such as that shown in FIG. 6(*b*), a delta-shaped arrangement such as that shown in FIG. 6(*c*), or another arrangement.

Droplet Discharge Method

The method for discharging droplets using the droplet discharge device 1 configured in the manner described above will be described next. In the present embodiment, a color filter is manufactured using the droplet discharge method.

First, the mother substrate 51 on which banks 53 have been formed is mounted on the work stage 12, and the upper surface of the mother substrate 51 and the droplet discharge heads 15 are disposed opposite each other, as shown in FIG. 1.

Figure 8:
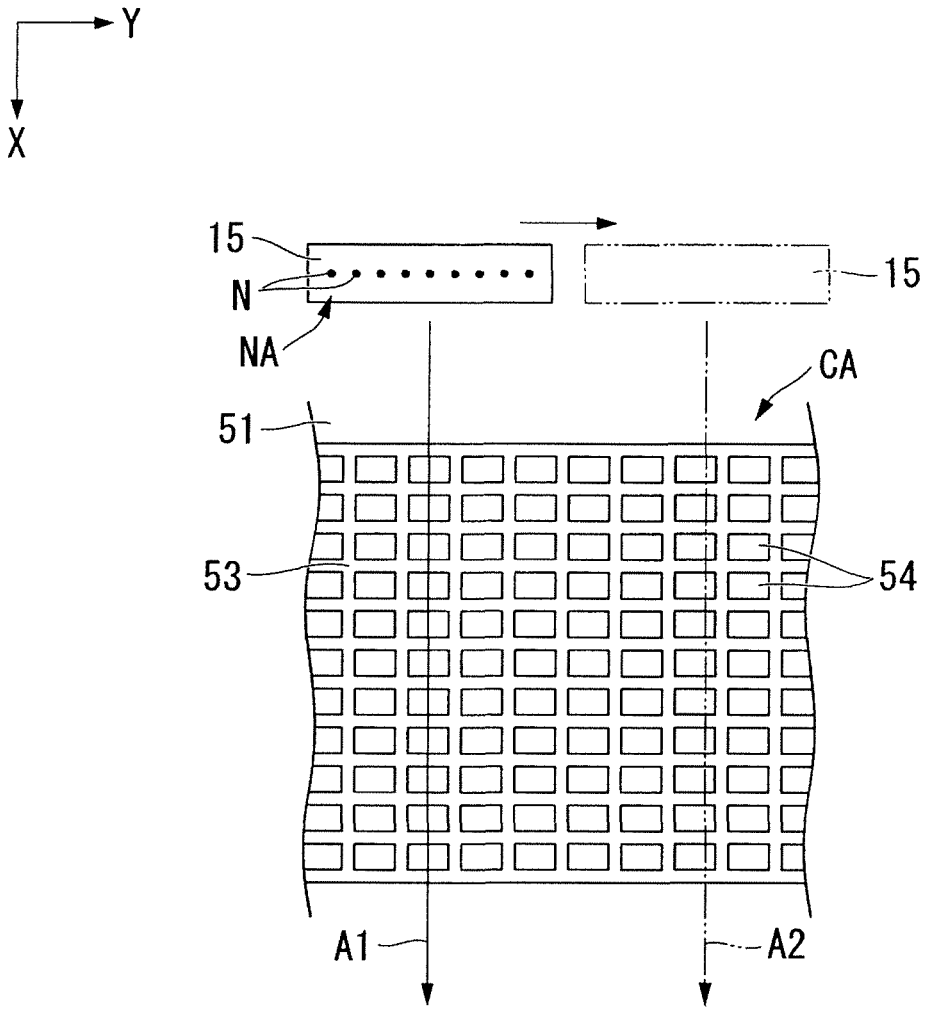
FIG. 8 is a schematic plan view for illustrating the droplet discharge method.

The liquid is discharged toward the drawing regions 54 from the plurality of nozzles N of the droplet discharge heads 15 (scan step) while the stage movement device 13 and the carriage movement device 16 are moved (scanned) relative to the mother substrate 51. In this situation, the droplet discharge heads 15 discharge the liquid onto the drawing regions 54 partitioned on the mother substrate 51 while the droplet discharge heads 15 are moved relative to the mother substrate 51 along the direction of the arrow A1, which is the primary scan direction, as shown in FIG. 8.

Figure 7:
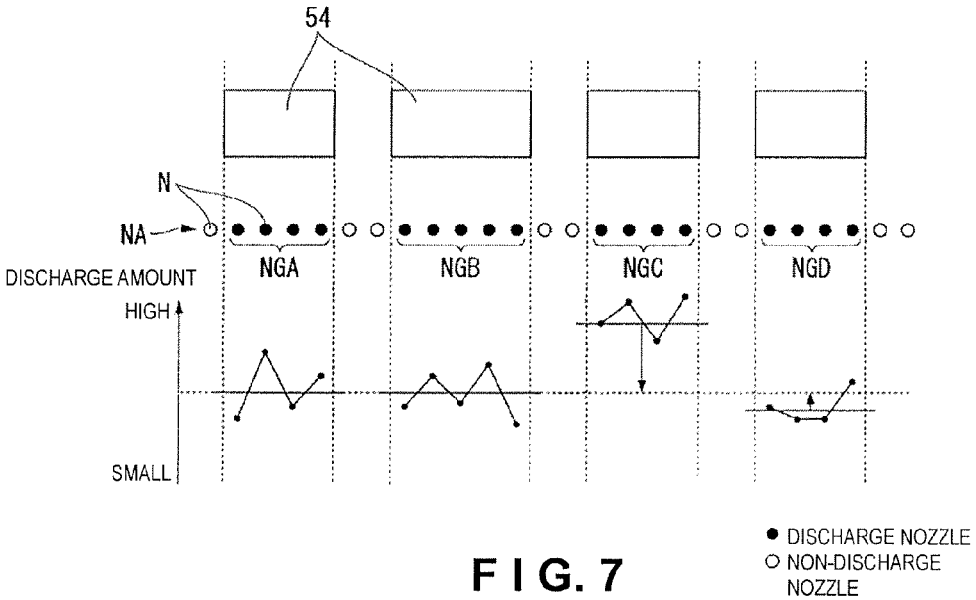
FIG. 7 is a descriptive view for illustrating the droplet discharge method.

Since each of the drawing regions 54 is arranged in the form of a matrix on the mother substrate 51, the liquid is not discharged in a simultaneous fashion from all of the nozzles N in the droplet discharge heads 15. Accordingly, among the plurality of nozzles N, there are nozzles N (discharge nozzles) that discharge the liquid when positioned above the drawing region 54 and there are nozzles N (non-discharge nozzles) that do not discharge the liquid when not positioned over the drawing region 54, as shown in FIG. 7. The discharge controller 42 groups (grouping step) the plurality of nozzles N into nozzle groups NG for each nozzle N positioned above the same drawing region 54.

In this present embodiment, variability occurs in the discharge amounts of the nozzles N, as shown in FIG. 7. In other words, the average value of the discharge amounts of the liquid discharged from the nozzles N constituting the nozzle group NGA is substantially the same as the average value of the discharge amounts in the nozzle group NGB, but the average value of the discharge amounts in the nozzle group NGC is high and the average value of the discharge amounts in the nozzle group NGD is low.

In view of the above, the discharge controller 42 selects the drive signal to be fed to the drive elements PZ that correspond to the nozzles N so that the average value of the discharge amounts of the liquid discharged from the nozzles constituting the nozzle groups NG are uniform at a predetermined amount in the nozzle groups NG. In other words, the discharge controller 42 selects from among four gradations the drive signal to be fed to the drive elements PZ that correspond to the nozzles N constituting the nozzle group NGC, and the average value of the discharge amount of the liquid discharged from the nozzles N constituting the nozzle group NGC is reduced. Also, the discharge controller 42 similarly increases the average value of the discharge amounts of the liquid discharged from the nozzles N constituting the nozzle group NGD.

Corrections are thus made in the nozzle groups NG so that the average value of the amounts of the liquid discharged from the nozzles N constituting the nozzle groups NG reaches a predetermined amount. The discharge controller 42 may correct the discharge amount of a portion of the plurality of nozzles N constituting the nozzle groups NG, or may correct the discharge amount for all the plurality of nozzles N constituting the nozzle groups NG.

Making corrections so that the average value of the discharge amounts of the liquid discharged from the nozzles N in the nozzle groups NG reaches a predetermined value thus makes the height of the liquid level formed by the liquid discharged into the drawing region 54 uniform.

Thereafter, the droplet discharge heads 15 are moved a predetermined distance in a relative fashion in the Y direction, which is the secondary scan direction, and then moved again in a relative fashion along the direction of the arrow A2, which is the primary scan direction. At this point, the discharge controller 42 regroups the plurality of nozzles N and corrects the discharge amounts of the liquid discharged from the nozzles N in the same manner as described above. In this situation, the color filter layer 55 is formed with reduced linear grayscale nonuniformity because the height of the liquid level of the liquid is uniform in the drawing regions 54.

The droplet discharge heads 15 are arranged along the Y direction, which is the secondary scan direction, but may also be arranged in a diagonally sloping direction with respect to the Y direction so that the pitch of the nozzles N and the pitch of the drawing regions 54 are in a predetermined correspondence relationship. The average value of the discharge amounts may be substantially uniform among the plurality of nozzle groups NG.

The color filter substrate 52 is manufactured in the manner described above. Thereafter, the mother substrate 51 is divided into panel regions CA to manufacture individual color filters 50.

As described above, in the droplet discharge method and droplet discharge device 1 of the present embodiment, the average value of the discharge amounts in the nozzles N constituting a single nozzle group NG is made equivalent to the average value of the discharge amounts in the nozzles N constituting the other nozzle groups NG, whereby the variability in the average value of the discharge amounts can be reduced to ¼ or less for the nozzle groups NG overall, even when the discharge amounts of the liquid are corrected in a stepwise manner in four steps. Accordingly, the average value of the discharge amounts can be more finely corrected for the nozzle groups NG overall in comparison with the case in which the discharge amounts are made uniform for all nozzles N. Therefore, the height of the liquid level of the liquid discharged into the drawing regions 54 becomes more uniform, and the occurrence of linear grayscale nonuniformity can be more reliably reduced.

The present invention is not limited to the embodiment described above, and various modifications can be made within range that does not depart from the spirit of the present invention.

For example, the discharge controller uses four steps to make corrections to the discharge amounts of the liquid discharged from the nozzles, but the corrections can be made in at least two steps, and the corrections can be made in multiple steps.

The droplet discharge device and the droplet discharge method are used for forming a color filter layer in a color filter, but other applications are possible as long as a thin film is formed by discharging a liquid into predetermined regions on a substrate, e.g., the formation of layers constituting a light-emitting layer in an organic EL device.

The movement mechanism is composed of a stage movement device and a carriage movement device, but also possible are configurations in which the carriage movement device is capable of moving in the XY plane, as well as other configurations, as long as the droplet discharge heads can be moved relative to the mother substrate.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A droplet discharge method for discharging a liquid into a plurality of drawing regions partitioned on a substrate from a plurality of nozzles formed in a droplet discharge head while moving the droplet discharge head relative to the substrate, the droplet discharge method comprising:

discharging the liquid from the nozzles while the droplet discharge head is moved relative to the substrate, the nozzles including first nozzles and a second nozzle that are arranged so that the first nozzles face the drawing regions, and so that the second nozzle faces a non-discharge area, the non-discharge area being disposed between the drawing regions;

dividing only the first nozzles into a plurality of nozzle groups so that the nozzles in one of the groups face the same drawing region;

comparing an average value of an amount of the liquid discharged from the nozzles constituting each of the nozzle groups with a predetermined average value; and increasing the average value such that the average value is substantially equal to the predetermined average value when the average value is lower than the predetermined average value, or decreasing the average value such that the average value is substantially equal to the predetermined average value when the average value is higher than the predetermined average value, by correcting an amount of the liquid discharged from each of the nozzles in each of the nozzle groups.

2. The droplet discharge method according to claim 1, wherein the correcting of the amount of the liquid discharged from the nozzles includes correcting the amount of the liquid discharged from each of the nozzles in a stepwise manner.

3. The droplet discharge method according to claim 2, wherein the amount of the liquid discharged from each of the nozzles is corrected in the stepwise manner by changing an intermediate electric potential of a drive signal applied to each of the nozzles, and the intermediate electric potential is a potential prior to rising to a highest electric potential of the drive signal in a charging state and higher than a lowest electric potential of the drive signal.

* * * * *